United States Patent [19]

Vasallo

[11] 4,070,782

[45] Jan. 31, 1978

[54] DESK ORNAMENT

[76] Inventor: Sergio A. Vasallo, 850 S. Miami Ave., Miami, Fla. 33130

[21] Appl. No.: 722,492

[22] Filed: Sept. 13, 1976

[51] Int. Cl.[2] ..... G09F 7/04

[52] U.S. Cl. ..... 40/323; 40/621; 40/358; 206/.84

[58] Field of Search ..... 40/323, 358, 10 R, 142 A; 206/.84, .8, .81, .82, .83; D19/96, 97, 95, 79, 80, 77, 75

[56] References Cited

U.S. PATENT DOCUMENTS

| | | | |
|---|---|---|---|
| D. 200,146 | 1/1965 | Mundrinich | D19/81 X |
| 3,010,228 | 11/1961 | Torre | 35/7 A X |
| 3,304,916 | 2/1967 | Abernethy | 40/358 |
| 3,412,846 | 11/1968 | Spadaro | 206/.83 |
| 3,474,897 | 10/1969 | Rambow | 206/.84 |
| 3,822,782 | 7/1974 | Ringle et al. | 206/.83 |

FOREIGN PATENT DOCUMENTS

| | | | |
|---|---|---|---|
| 969,625 | 5/1950 | France | 40/323 |

*Primary Examiner*—John F. Pitrelli

[57] ABSTRACT

A paper weight and decorative display item for desks which includes a main body having an upper surface with a plurality of recesses sized to receive different size coins and a name tag plate on the front surface on an incline, and which name tag may be removed for changing depending upon the person who is using the paper weight.

1 Claim, 3 Drawing Figures

DESK ORNAMENT

FIELD OF THE INVENTION

This invention relates to a display device and paper weight for desks.

BACKGROUND OF THE INVENTION

In the past there have been numerous types of display devices for desks. This is such a display device which can be used as a paper weight, and, additionally, has a name plate zone. Generally speaking, it composes a body having an upper surface and a lower surface and a plurality of recesses in the top surface in which recesses are provided to receive coins and a decorative design is centrally arranged and, additionally, a flag staff recess is provided to receive a flag staff and the front surface which includes a name plate removably attached thereto, preferably by a magnet.

In accordance with the foregoing, it is a general object of this invention to provide a simple and inexpensive display device and paper weight which also includes a name plate which may be removed and exchanged for a different name plate and which is inexpensive to manufacture and otherwise well suited for the purposes specified herein and which, additionally, can be used to display the bicentennial symbol.

In accordance with these and other objects which will become apparent hereinafter, the instant invention will now be described with reference to the accompanying drawings, in which:

DESCRIPTION OF PREFERRED EMBODIMENT

Figure 1:
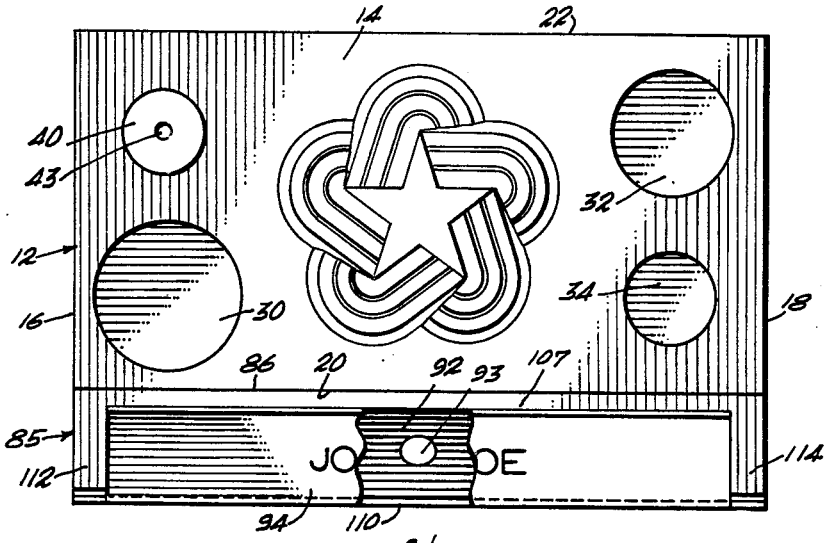
FIG. 1 is a plan view of the instant invention.
Figure 2:
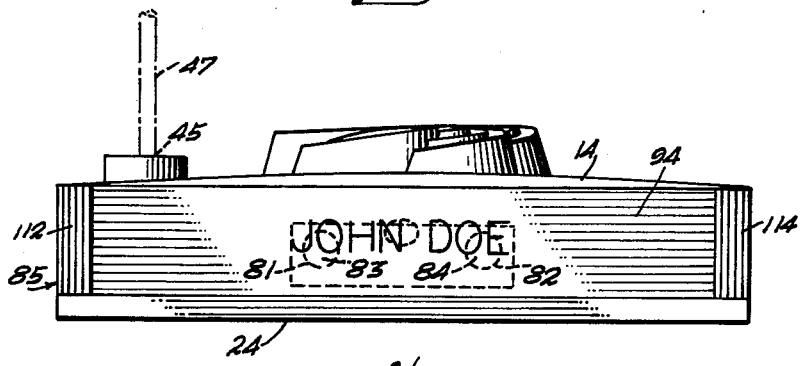
FIG. 2 is a front elevation view of the instant invention.
Figure 3:
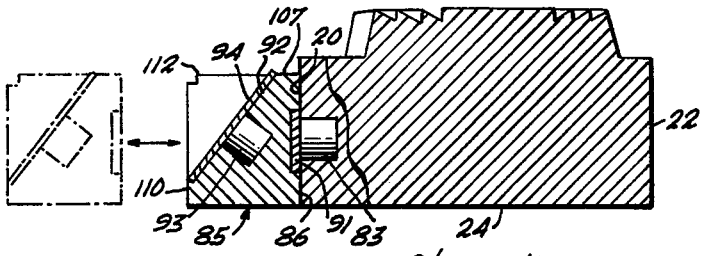
FIG. 3 is a view in cross section taken on the medial plane of FIGS. 1 and 2.

Referring to the drawings wherein like reference characters designate like or corresponding parts throughout the several views and referring particularly to FIG. 1, there is shown a body 12 having an upper surface 14, side surfaces 16 and 18, front and rear surfaces 20 and 22 and a bottom surface 24. In the top surface there are a plurality of recesses 30, 32 and 34 of different sizes roughly equivalent to and sized for mating nesting of coins of the bicentenial year 1976. These are generally speaking at three of the corners of the top surface as seen in plan. At the other corner there is a raised cylindrical portion 40 with an axially, upwardly opening recess 43 for the end 45 of a flag staff 47; and in the central zone of the top surface there is a design, preferably of the bicentenial symbol. The front surface includes a pair of recesses centrally arranged at a common height in which magnet members are arranged, the recesses being designated by the numerals 81 and 82 and the magnet means by the numerals 83 and 84. There is a name plate portion 85 which has a surface 86 which confronts the front surface 20 and which also includes a metallic plate 91 embedded therein for engagement by magnets 83 and 84, additionally, a front end inclined surface 92 is provided with a magnet 93 embedded therein to engage and hold a metallic name plate 94 against inclined surface 91 between an upper surface 107, a front surface 110 and generally squared side portions 112 and 114.

It is thus seen that there is provided a simple and inexpensive device which can be used as a paper weight and which, also, includes a flag staff or, alternatively, may be a pen holder and which, further, provides a name tag when the person occupying a desk or position, for example, in a bank, is changed.

What is claimed is:

1. A decorative paper weight device comprising a body of relatively dense material having a bottom surface of plane form and an upper surface, said upper surface having a) a plurality of spaced recesses in a pattern, each of said recesses being sized to snugly receive and display the main surface of a coin of a predetermined year, and b) an embossed symbol on the upper surface centrally arranged with respect to said pattern, and c) a recess sized to receive a flag staff; and said body having a front surface, and magnetic means embedded in said front surface and a name tag means companionately sized to cover a major portion of said front surface and said name tag means including metallic plate means to attach to the magnetic means, whereby the name tag means is removable from said front surface, and said name tag means comprises a block sized to extend across the front surface between the upper and lower surface of the paper weight device and said tag means includes an inclined front surface extending downwardly from the level of said upper surface toward said outer surface and outwardly away from said front surface and comprising an inclined surface and a name tag plate sized and fitted on the inclined surface and means removably mounting said plate on said inclined surface.

* * * * *